US010718172B2

(12) United States Patent
Thow et al.

(10) Patent No.: US 10,718,172 B2
(45) Date of Patent: Jul. 21, 2020

(54) FLUID LOSS AND GAIN FOR FLOW, MANAGED PRESSURE AND UNDERBALANCED DRILLING

(71) Applicant: Schlumberger Technology Corporation, Sugar Land, TX (US)

(72) Inventors: Paul Andrew Thow, Spring, TX (US); Yawan Couturier, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 285 days.

(21) Appl. No.: 15/737,306

(22) PCT Filed: Jun. 27, 2016

(86) PCT No.: PCT/US2016/039498

§ 371 (c)(1),
(2) Date: Dec. 17, 2017

(87) PCT Pub. No.: WO2016/210398

PCT Pub. Date: Dec. 29, 2016

(65) Prior Publication Data

US 2018/0135367 A1 May 17, 2018

Related U.S. Application Data

(60) Provisional application No. 62/184,673, filed on Jun. 25, 2015.

(51) Int. Cl.
*E21B 21/08* (2006.01)
*E21B 21/06* (2006.01)
(Continued)

(52) U.S. Cl.
CPC ..... *E21B 21/08* (2013.01); *E21B 21/065* (2013.01); *E21B 21/067* (2013.01); *E21B 47/06* (2013.01); *E21B 21/003* (2013.01)

(58) Field of Classification Search
CPC ..... E21B 21/08; E21B 21/067
See application file for complete search history.

(56) References Cited

U.S. PATENT DOCUMENTS 3,498,393 A * 3/1970 Pearce ..... E21B 21/067 175/48
2003/0168258 A1 9/2003 Koederitz
(Continued)

OTHER PUBLICATIONS

International Preliminary Report on Patentability for the equivalent International patent application PCT/US2016/039498 dated Jan. 4, 2018.

(Continued)

*Primary Examiner* — Robert E Fuller
(74) *Attorney, Agent, or Firm* — Jeffrey D. Frantz

(57) ABSTRACT

A method for monitoring a well bore during drilling operations, particularly with respect to a fluid gain and/or fluid loss event. Monitoring the well bore may be accomplished by monitoring an incoming flow rate of the fluid into the wellbore. The fluid return line from the well bore may carry drilling fluid from the well bore to a mud gas separator located downstream from the well bore. Changes in at least one parameter of the mud gas separator may be monitored. The changes to the at least one parameter of a mud gas separator may be compared to the incoming flow rate of the fluid. Discrepancies between the changes and the incoming flow rate may be indicative of a fluid gain or fluid loss condition.

12 Claims, 3 Drawing Sheets

(51) Int. Cl.
*E21B 47/06* (2012.01)
*E21B 21/00* (2006.01)

(56) References Cited

U.S. PATENT DOCUMENTS

| | | | |
|---|---|---|---|
| 2008/0041149 | A1 | 2/2008 | Leuchtenberg |
| 2011/0139464 | A1 | 6/2011 | Henderson et al. |
| 2012/0165997 | A1 | 6/2012 | Lewis et al. |
| 2015/0167413 | A1 | 6/2015 | Leuchtenberg et al. |

OTHER PUBLICATIONS

International Search Report and Written Opinion for the equivalent International patent application PCT/US2016/039498 dated Oct. 11, 2016.

* cited by examiner

FLUID LOSS AND GAIN FOR FLOW, MANAGED PRESSURE AND UNDERBALANCED DRILLING

CROSS-REFERENCE TO RELATED APPLICATION

The present document is based on and claims priority to U.S. Non-Provisional Application Ser. No. 62/184,673, filed Jun. 25, 2015, which is incorporated herein by reference in its entirety.

BACKGROUND

During drilling operations drilling fluid is pumped downhole to, among other things, provide hydrostatic pressure against the formation being drilled. The hydrostatic pressure provided by the drilling fluid in the annulus provides a static head which assists in maintaining the hydrostatic equilibrium in the wellbore, thereby controlling formation fluid pressure to prevent a significant influx of fluid from the formation (i.e., a kick) and minimizing fluid loss into and stabilizing the formation through which the well is being drilled.

In under balanced drilling, a rotating control device is used to close the borehole from external conditions, however the downhole pressure is maintained below a formation pressure. During underbalanced drilling fluid enter the formation due to the pressure gradient between the formation and the wellbore. While a small influx from the formation is tenable, a significant influx formation may slow drilling operations as well as increase the cost of drilling the well.

In managed pressure drilling, a rotating control device is used to close the borehole from external conditions, while a series of chokes and a back pressure system controls the downhole pressure in order to maintain a desired bottomhole pressure. A concern with managed pressure drilling and underbalanced drilling is the potential for a large fluid influx from a high pressure pocket in the formation, otherwise known as a "kick." A kick is caused by the intrusion of salt water, formation fluids or gases into the drilling fluid which may lead to a blowout condition. Blowouts are hazardous, costly, and time consuming. A kick or blowout, if not mediated, may result in damage to drilling tools and systems and cause injury or death of workers.

SUMMARY

In one aspect, embodiments disclosed herein relate to a method for monitoring a well bore during drilling operations, particularly with respect to a fluid gain and/or fluid loss event. Monitoring the well bore may be accomplished by monitoring an incoming flow rate of the fluid into the wellbore. The fluid return line from the well bore may carry drilling fluid from the well bore to a mud gas separator located downstream from the well bore. Changes in at least one parameter of the mud gas separator may be monitored. The changes to the at least one parameter of a mud gas separator may be compared to the incoming flow rate of the fluid. Discrepancies between the changes and the incoming flow rate may be indicative of a fluid gain or fluid loss condition.

In another aspect, embodiments disclosed herein relate to a drilling system. The drilling system may include an inflow line supplying fluid to a wellbore. A return line may carry fluid from the wellbore. The return line may carry the fluid to a mud gas separator disposed downstream from the wellbore. The mud gas separator may include at least one sensor to measure a parameter of the mud gas separator.

In yet another aspect, embodiments disclosed herein relate to a method for monitoring a well bore. The method may include measuring an incoming flow rate of fluid pumped into a wellbore. Additionally, at least one parameter of a mud gas separator in fluid communication with the wellbore may be measured. The incoming flow rate and the at least one parameter may be recorded. With the measured data, a variance in the at least one parameter with respect to the incoming flow rate may be determined to identify a fluid loss and/or fluid gain event.

Other aspects and advantages of the embodiments will be apparent from the following description and the appended claims. The various characteristics described above, as well as other features, will be readily apparent to those skilled in the art upon reading the following detailed description, and by referring to the accompanying drawings.

DETAILED DESCRIPTION

Accordingly, one or more embodiments of the present disclosure are directed to drilling systems and methods for oil and gas drilling while simultaneously monitoring the drilling operations for fluid loss and/or gain (e.g. kick) events. Specifically, aspects of the present disclosure are directed to drilling systems and methods to allow earlier and more accurate detection of a fluid loss and/or gain event. Aspects of the present disclosure may also be used to provide detection of fluid loss and/or gain events for formations that have significant amounts of entrained gas (e.g., shale) in the formation.

Embodiments of the present disclosure are directed to a drilling system having a mud gas separator in fluid communication with a wellbore. The mud gas separator is provided to receive drilling fluid from the wellbore and remove entrained gases from the drilling fluid and cuttings solids prior to further separation of the solids laden drilling fluid. As used herein, the term "solids laden drilling fluid" refers to drilling fluid from the wellbore having cuttings solids therein. A mud gas separator in accordance with embodiments of the present disclosure includes a sensor disposed thereon to measure at least one parameter of the mud gas separator.

The at least one parameter may include, but is not limited to, a height of fluid in the mud gas separator, an internal pressure of the mud gas separator, an amount of gas discharged from the mud gas separator, a flow rate of gas discharged from the mud gas separator, and a weight of the mud gas separator. These parameters may be monitored with one of the above described sensors. The measurements of the at least one parameter of the mud gas separator may be used to determine changes in the wellbore that would be indicative of an impending fluid loss and/or gain event. In the event a fluid loss and/or gain event is detected, a user may implement corrective actions to prevent and/or mitigate issues caused by the fluid loss and/or gain event.

Figure 1:
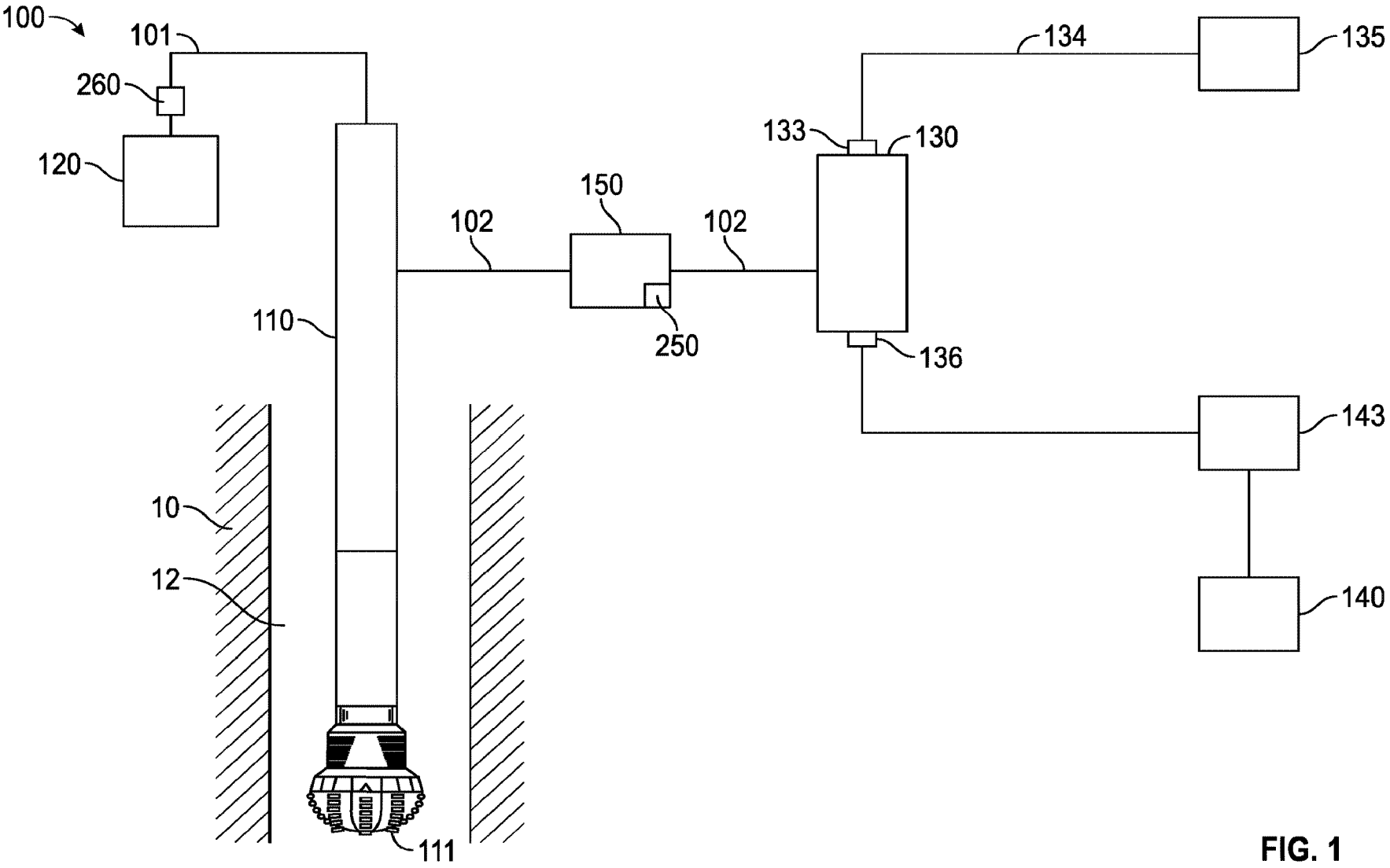
FIG. 1 shows a schematic diagram of a wellbore set up in accordance with embodiments of the present disclosure.

FIG. 1 is a simplified diagram of a drilling system 100 that may be utilized in accordance with embodiments of the present disclosure. The drilling system 100 as illustrated includes a drill string 110 positioned in a wellbore 12 extending through a formation 10. The drill string 110 is in fluid communication with a storage pit or tank 120. A pump 121 may be positioned along the fluid in-flow line 101 to pump the drilling fluid from the storage tank 120 into the drill string 110. According to some embodiments, the in-flow line 101 may include a sensor 260 coupled there to for monitoring an incoming flow rate of fluid into the wellbore 12. The sensor may be a flow sensor, standpipe pressure sensor, and/or device for monitoring a pump rate of the fluid delivered downhole.

The drilling fluid provided to the drill string 110 may exit the drill string 110 at the bottom of the wellbore 12 proximate a drill bit 111 disposed on a distal end of the drill string 110. The drilling fluid may remove fresh cuttings from the cutting surfaces of the drill bit and carry the cuttings up through the annulus (i.e., the space between the drill string and the walls of the wellbore 12) toward the surface. This solids laden drilling fluid may be carried from the wellbore 12 through return line 102 for processing.

The return line 102 may provide the solids laden drilling fluid to a mud gas separator 130. In accordance with embodiments of the present disclosure, the mud gas separator 130 may include one or more sensors. The one or more sensors are provided to monitor at least one parameter of the mud gas separator 130. For example, the at least one sensor may measure a height of fluid in the mud gas separator, an internal pressure of the mud gas separator, an amount of gas discharged from the mud gas separator, a flow rate of gas discharged from the mud gas separator, and/or a weight of the mud gas separator. An expected value of these parameters may be known for static (i.e., no flow) and steady state flow (i.e., during drilling operations with no fluid loss or fluid gain events) conditions.

Figure 2:
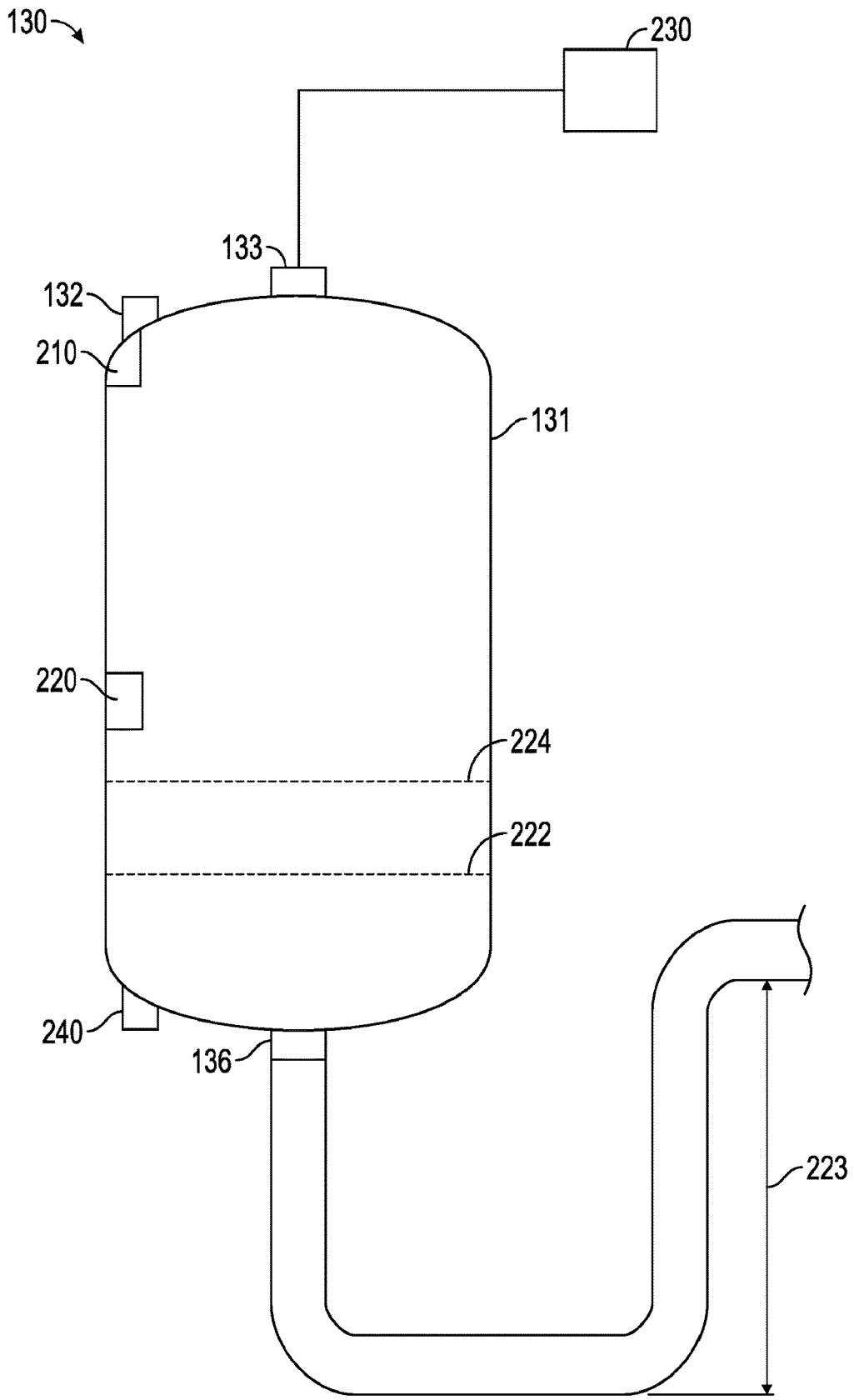
FIG. 2 shows a perspective view of a mud gas separator in accordance with embodiments of the present disclosure.

Referring to FIG. 2, these parameters may be monitored with a sensor disposed on, in, or about the mud gas separator 130. The one or more sensors may refer to, for example, a pressure sensor 210, a gas flow meter 230, a level sensor 220, and a load cell 240. One skilled in the art will understand that the parameters measure and the type of sensor used are not intended to limit the scope of the present disclosure and that other sensors may be used and other parameters may be measured without departing from the scope of the present disclosure. The mud gas separator 130 may also include a tank vessel 131, a fluid inlet 132, a gas outlet 133, and a fluid outlet 136. Within the tank vessel 131 a plurality of baffles (not shown) may be disposed for separating the entrained gas from the solids laden fluid.

In one or more embodiments, the pressure sensor 210 may be disposed in the tank vessel 131 for measuring an internal pressure of the mud gas separator 130. The pressure sensor 210 may be any pressure sensor known and used in the art suitable for measuring the internal pressure of a mud gas separator.

In one or more embodiments, the level sensor 220 may be disposed in the tank vessel 131 for measuring a height of fluid within the vessel 131. The level sensor may include, for example float level sensors, ultrasonic, optical, etc. During static conditions, a height 222 of the fluid may be level with a height 223 of the U-tube. During steady state conditions, a height 224 of the fluid may be proximate a lower edge of a bottom baffle. One skilled in the art will understand that any sensor capable of monitoring a height of a fluid within a vessel 131 may be used without departing from the scope of the present disclosure and that level sensor 220 is provided as an example of a type of sensor for measuring a height of fluid.

Referring again to FIG. 1, in one or more embodiments, the gas flow meter 230 may be disposed proximate the gas outlet 133 of the mud gas separator and/or along a flare line 134. The flare line 134 may be located between and in fluid communication with the gas outlet 133 and a flare 135 for disposal and/or recovery of the gas removed by the mud gas separator 130. The gas flow meter 230 is provided for monitoring the volume of gas removed from the solids laden drilling fluid. One skilled in the art will understand that any sensor capable of monitoring a volume of gas removed may be used without departing from the scope of the present disclosure, for example, a gas flow meter, ultrasonic, optical, etc., may be used.

In one or more embodiments, the load cell 240 may be used to monitor a weight of the vessel 131 of the mud gas separator. Measuring the weight of the vessel 131 may be used to determine the contents of the vessel 131, e.g., an amount of mud flowing through the vessel. One skilled in the art will understand that any sensor capable of monitoring a weight of the vessel 131 may be used without departing from the scope of the present disclosure. The load cell 240 may be disposed on a bottom of the vessel 131 to measure any changes in the weight of the vessel 131 during the drilling process.

One skilled in the art will understand that the number and type of sensor used is not intended to limit the scope of the present disclosure. For example, embodiments of the present disclosure may include all of the above described sensors. Other embodiments may include one, two, or three of the sensors. One skilled in the art may also appreciate that a greater number of sensors used may correspond to a greater accuracy in monitoring the wellbore for fluid loss and/or gain events.

Figure 3:
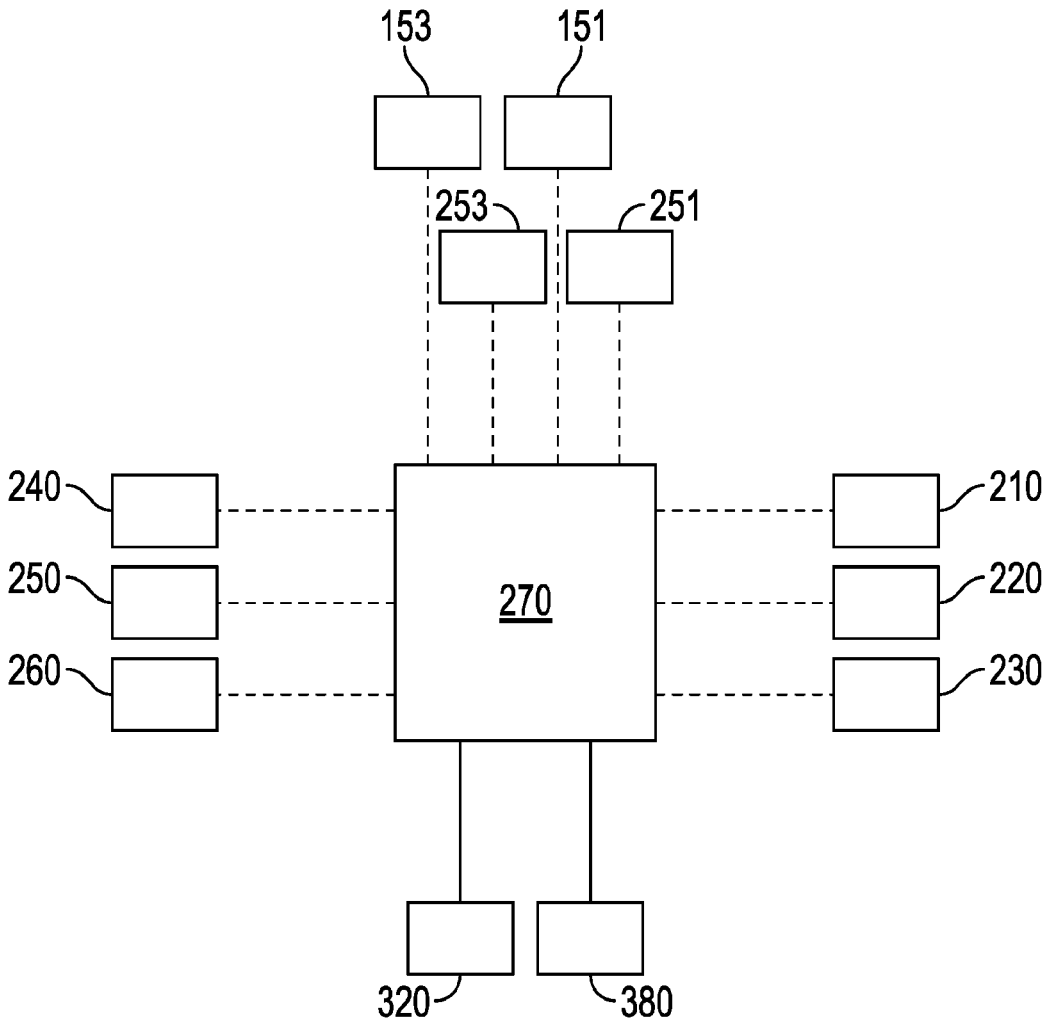
FIG. 3 shows a schematic diagram of a sensor network in accordance with embodiments of the present disclosure.

Referring to FIG. 3, each of the sensors 210, 220, 230, 240 disposed on, in, or about the mud gas separator 130 may be operatively connected to a processor 270, e.g., a computer. As used herein, the term "operatively connected" may refer to a wired or wireless connection. For example, according to some embodiments, the one or more sensors may communicate wirelessly to a processor 270. The processor 270 may record and compile the data. The processor may also be operatively connected to display 380 to display the data to a user for evaluation. In some embodiments, the processor may include software to automatically detect abnormal changes in the data from the one or more sensors and inform a user of the changes. One skilled in the art will understand that various sensors included in the drilling system 100, e.g., sensor 260, may also be operatively connected to the processor 270 without departing from the scope of the present disclosure.

Referring again to FIG. 1, the mud gas separator 130 is provided to remove entrained gases from the solids laden fluid. As noted above, gases are removed from the mud gas separator 130 via flare line 134 and delivered to a flare 135 or similar equipment for disposal and/or recovery. The remaining solids laden fluid may be delivered via a fluid line 136 for further processing. A flow rate and/or pressure of the fluid exiting the mud gas separator 130 in fluid line 136 may be monitored by flow meter 253 and pressure sensor 251, respectively. The solids laden fluid may be delivered to a separatory device 143 (e.g., a vibratory separator) to remove the cuttings solids and/or undesirable components from the drilling fluid. After processing, the drilling fluid may be stored in a mud pit 140. According to some embodiments, mud pit 140 may be in fluid communication with storage pit 120 and/or mud pit 140 and storage pit 120 may be the same feature.

A choke manifold 150 may be disposed along the return line 102 between the wellbore 12 and the mud gas separator 130. The choke manifold 150 may include at least one choke or valve and may mediate downhole pressure before providing the solids laden drilling fluid to surface equipment. Return line 102 may have pressure sensors 151 disposed before and/or after the choke manifold 150 to monitor a pressure of the return line 102 before and after the choke manifold 150. In some embodiments, return line 102 may have flow meters 153 disposed before and/or after the choke manifold 150 to monitor a flow rate of fluid within the return line 102 before and after the choke manifold 150. According to some embodiments of the present disclosure at least one sensor 250, e.g., a position sensor, may be provided to the choke system to monitor a position of the at least one choke.

Referring to FIGS. 1 and 3, in some embodiments, the drilling system 100 may include a programmable logic controller 320. The programmable logic controller 320 may be operatively connected various components of the drilling system 100, including, but not limited to, the processor 270, the drill string 110, fluid pump 121, and choke manifold 150. One skilled in the art will understand that the programmable logic controller 320 may be operatively connected to other components of the drilling system without departing from the scope of the present disclosure. The processor 270 may send instructions to the programmable logic controller 320 based on an automated system and/or user prompt. The automated system may send instructions based on the measurements from the one or more sensors coupled to the processor, without input from a user. For example, the automated system may determine that the back pressure should be increased and may send instructions from the processor 270 to the programmable logic controller 320 to close a valve in the choke manifold. The programmable logic controller 320 may then send those instructions to the relevant component, for example, the programmable logic controller 320 may communicate with the choke manifold 150 to close the appropriate choke. Any reference herein to an action taken or prompted by a user may also be taken or prompted by an automated system, and vice versa.

According to another aspect of this disclosure, there is provided a method of monitoring a wellbore while drilling. During drilling operations, a drilling fluid may be pumped downhole. The drilling fluid may be pumped from a storage pit 120 through an in-flow line 101 and into a drill string 110 disposed in the wellbore 12. The flow rate of fluid into the well bore may be monitored. For example, a flow sensor 260 may be provided for monitoring an incoming flow rate of fluid into the wellbore 12. The measurements from the flow sensor 260 may be transmitted (wirelessly or through wires) to a processor 270. In other embodiments, measurements from other sensors, e.g., a sensor disposed on pump 121 to monitor a pump rate, may be used to infer the flow rate of fluid into the well bore. The processor 270 may record and analyze the measurements from the sensor monitoring the flow rate of fluid, e.g., flow sensor 260.

The drilling fluid is pumped down toward a distal end of the drill string 110 and may exit the drill string 110 at a drill bit 111 or bottomhole assembly disposed at a distal end of the drill string 110. The drilling fluid may remove fresh cuttings from the surface of the drill bit and carry the cuttings in a space between the walls of the wellbore 12 and/or casing up toward the surface. The solids laden fluid may then be delivered to a return line 102 for processing. The return line 102 may carry the solids laden drilling fluid to a mud gas separator 130 disposed downstream from the wellbore 12. Once in the mud gas separator 130, the solids laden fluid may flow over a series of baffles (not shown) to remove the entrained gas from the solids laden fluid. The entrained gas may exit a vessel 131 of the mud gas separator 130 through the gas outlet 133 and be carried via a flare line 134 to a flare for disposal and/or recovery. The solids laden fluid may exit the vessel 131 through fluid outlet 136.

One or more parameters of the mud gas separator 130 disposed downstream from the wellbore 12 may be monitored. Particularly, changes in the one or more parameters of the mud gas separator 130 may be monitored. The monitoring of the one or more parameters may be performed in real-time during drilling and processing of fluid in the mud gas separator. The one or more parameters may include at least one selected from a height of fluid in the mud gas separator, an internal pressure of the mud gas separator, an amount of gas discharged from the mud gas separator, a flow rate of gas discharged from the mud gas separator, and a weight of the mud gas separator. These parameters may be monitored with one of the above described sensors. For example, the level sensor 220 may be used to monitor the height of the fluid, the pressure sensor 210 may monitor an internal pressure of the vessel, the gas flow meter 230 may monitor an amount of gas discharged from the mud gas separator and/or a flow rate of the gas discharged, and the load cell 240 may monitor the weight of the mud gas separator.

The one or more sensors may be operatively connected to the processor 270 for communicating the data based on the one or more parameters of the mud gas separator 130 to the processor 270. The processor 270 may record and analyze the data from the one or more sensors. The incoming flow rate may provide a baseline for comparing measurements taken by the sensors provided to measure a parameter of the mud gas separator 130 (e.g., 210, 220, 230, 240). For example, for an increase in flow rate into the wellbore, one skilled in the art would expect such an increase to be reflected in the at least one measured parameter of the mud gas separator. As such, the changes in the one or more parameters of the mud gas separator may be compared to incoming flow rate of fluid to determine the existence of a fluid loss and/or gain event.

Once the solids laden fluid exits the mud gas separator, the solids laden fluid may be sent for further processing. For example, the solids laden fluid may be delivered to a separatory device 143 to remove the cuttings solids from the fluid. Once the drilling fluid has been processed, the drilling fluid may be delivered to a mud pit 140 for storage and/or disposal.

In some embodiments, a position of a valve and/or choke of the choke manifold 150 located between the wellbore 12 and the mud gas separator 130 may be monitored. One skilled in the art will understand that similar to monitoring the incoming flow rate of the fluid provided to the wellbore 12, the position, i.e., if the valve is open or closed, of the valve will affect the amount of solids laden fluid delivered to the mud gas separator 130 as well as the measurements of the sensors disposed about the mud gas separator 130. In other words, the measurement provided by the position of the valve may be used to further calibrate the measurements taken by the one or more sensors 210, 220, 230, and 240 to detect a fluid loss and/or gain event.

When a fluid gain event is detected, appropriate action may be taken by a user or an automated system. Detection of a fluid gain event may include at least one of a height increase of drilling fluid in the mud gas separator 130, an increase in internal pressure of the vessel 131, an increase in a volume of gas discharged through gas outlet 133, and an increase in weight of the mud gas separator 130. In response, a user or automated system may take appropriate actions based on well control conventions, for example, reducing a flow rate of fluid into the wellbore 12.

Conversely, when a fluid loss event is detected, appropriate action may be taken by a user. Detection of a fluid loss event may include at least one of a height decrease of drilling fluid in the mud gas separator 130, a decrease in internal pressure of the vessel 131, a decrease in a volume of gas discharged through gas outlet 133, and a decrease in weight of the mud gas separator 130. In response, a user may decrease the flow rate of fluid into the wellbore 12 modify the fluid to decrease the fluid density or viscosity, remove backpressure with the choke manifold 150, and/or include, for example, lost circulation materials or other wellbore strengthening materials.

Further, according to one or more aspect of this disclosure, there is provided a method for detecting a fluid loss and/or gain event. The method of detecting may include, measuring an incoming flow rate of fluid pumped into a wellbore. A flow sensor 260 may be disposed along an in-flow line 101 for monitoring the incoming flow rate of fluid into the wellbore 12.

Simultaneously, at least one sensor may be disposed in, on, or about a mud gas separator to measure a corresponding parameter of the mud gas separator 130 in fluid communication with the wellbore 12. The at least one sensor may be one selected from, for example, a level sensor 220, a pressure sensor 210, a gas flow meter 230, a gas flow meter, and a load cell 250 and disposed on, in, or about the mud gas separator. Each of the at least one sensors may measure at least one parameter of the mud gas separator, for example, a height of fluid in the mud gas separator, an internal pressure of the mud gas separator, an amount of gas discharged, and a weight of the mud gas separator. In some embodiments, additional sensors may be placed in, on, or about other components of the drilling system 100, for example, position sensor 250 located on the choke manifold 150.

Measurements from the sensors may be recorded. For example the sensors 210, 220, 230, 240, 250, 260 may be operatively coupled to a processor 270. The processor 270 may record the incoming flow rate as well as the at least one parameter of the mud gas separator 130. The measurements of the incoming flow rate may be compared to the measurements of the at least one parameter of the mud gas separator. Particularly, any variance in the measurements of the at least one parameter of the mud gas separator from sensors 210, 220, 230, and 240 may be used to identify a fluid loss and/or fluid gain event. For example, if the rate of incoming fluid flow to the wellbore remains constant, and measurements indicate an increase in a height of the fluid within the vessel 131 of the mud gas separator 130, a fluid gain event may have occurred. The increase in the height of the fluid within the vessel 131 may be relatively small and still be indicative of a fluid gain event, particularly, when more than one sensor indicates a fluid gain event.

The recorded data and the resulting analysis may be displayed to a user. In some embodiments, an automated system may respond to the adverse fluid event. In some embodiments, the user may ultimately decide how to address any detected wellbore event. For example, a user may increase and/or decrease a pump rate of fluid to the wellbore based on the variance at least one parameter to the incoming flow rate of fluid. In other embodiments, a user may adjust the backpressure using the choke manifold or initiate secondary well control. For example, for a fluid influx, e.g., kick, secondary well control may include stopping drill string rotation, raising the drill string to a shut-in position, stopping the pumping of fluid down hole, closing an annular preventer and opening a choke line valve, which may be a part of the choke manifold, sounding an alarm to notify a person in charge. If the well has been closed with the annular preventer, then the secondary well control may also include inspecting pipe rams and the tool joint relative position, closing the pipe rams and ram locks, and bleeding off pressure between the pipe rams and annular preventer. Once the secondary well control response is completed, the kick may be circulated out using, for example, the Driller's method, Wait and Weight method, and/or Volumetric method.

Accordingly, embodiments of the present disclosure provide systems and methods for determining a fluid loss and/or fluid gain event. By monitoring parameters of a mud gas separator, embodiments of the present disclosure may detect changes in the flow-out of drilling fluid from the wellbore indicative of a fluid loss or fluid gain event. For example, by monitoring parameters related to the gas content of the solids laden drilling fluid a more accurate determination of pressure change in the wellbore due to fluid loss or fluid gain may be determined. Particularly, embodiments of the present disclosure take into account factors involving the gas content of the solids laden fluid as opposed to drilling systems that may simply monitor changes in the flow-out of drilling fluid from the wellbore and/or a parameter of the mud/storage pit.

Although the preceding description has been described herein with reference to particular means, materials and embodiments, it is not intended to be limited to the particulars disclosed herein. Rather, it extends to all functionally equivalent structures, methods and uses, such as are within the scope of the appended claims.

What is claimed is:

1. A method comprising:

monitoring an incoming flow rate of a fluid into a wellbore, wherein the monitoring the incoming flow rate further comprises measuring the incoming flow rate with a flow sensor;

monitoring, via at least one other sensor, changes in at least one parameter of a mud gas separator disposed downstream from and in fluid communication with the wellbore via a return line, wherein a choke manifold is disposed along the return line between the wellbore and the mud gas separator;

comparing, via a processor, the changes in the at least one parameter of the mud gas separator to the incoming flow rate of the fluid;

detecting a fluid event based on the comparison; and in response to detecting the fluid event, at least one of (i) adjusting the incoming flow rate of the fluid into the wellbore and/or the fluid density and (ii) adjusting backpressure at the choke manifold.

2. The method of claim 1, further comprising monitoring a position of a valve of the choke manifold located between the wellbore and the mud gas separator.

3. The method of claim 1, wherein the detecting the fluid event further comprises detecting a fluid gain event.

4. The method of claim 3, wherein the detecting the fluid gain event includes detecting one of a height increase of fluid in the mud gas separator, an increase in internal pressure, an increase in a volume of gas discharged, and an increase in weight of the mud gas separator.

5. The method of claim 1, further comprising the adjusting the incoming flow rate of the fluid into the wellbore and/or the fluid density, wherein the adjusting the incoming flow rate of the fluid into the wellbore and/or the fluid density comprises increasing the incoming flow rate of the fluid into the wellbore and/or increasing the fluid density.

6. The method of claim 5, wherein the adjusting the incoming flow rate of the fluid into the wellbore and/or the fluid density further comprises decreasing the incoming flow rate of the fluid, decreasing the fluid density, adding lost circulation materials, and/or adding wellbore strengthening materials.

7. The method of claim 1, wherein the detecting the fluid event further comprises detecting a fluid loss event.

8. The method of claim 7, wherein the detecting the fluid loss event includes detecting one of a height decrease of fluid in the mud gas separator, a decrease in internal pressure, a decrease in a volume of gas discharged, and a decrease in weight of the mud gas separator.

9. A method comprising:

measuring, via a sensor, an incoming flow rate of fluid pumped through an in-flow line and into a wellbore;

measuring, via at least one other sensor, at least one parameter of a mud gas separator in fluid communication with the wellbore via a return line, wherein a choke manifold is disposed along the return line between the wellbore and the mud gas separator;

recording, via a processor, the incoming flow rate and the at least one parameter;

determining a variance in the at least one parameter with respect to the incoming flow rate to identify a fluid loss and/or a fluid gain event; and at least one of adjusting a pump rate of fluid downhole and adjusting backpressure at the choke manifold based on the variance.

10. The method of claim 9, wherein the measuring, via the at least one other sensor, the at least one parameter of the mud gas separator includes monitoring at least one selected from a height of fluid in the mud gas separator, an internal pressure of the mud gas separator, an amount of gas discharged, and a weight of the mud gas separator.

11. The method of claim 9, wherein the recording is displayed to a user.

12. The method of claim 9, further comprising:

disposing the sensor along the in-flow line carrying the fluid pumped into the wellbore; and disposing the at least one other sensor on the mud gas separator.

* * * * *